US011458492B2

(12) United States Patent
Song et al.

(10) Patent No.: US 11,458,492 B2
(45) Date of Patent: Oct. 4, 2022

(54) CLEANING APPARATUS

(71) Applicant: LG ELECTRONICS INC., Seoul (KR)

(72) Inventors: Sungho Song, Seoul (KR); Sungmin Ye, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 343 days.

(21) Appl. No.: 16/476,146

(22) PCT Filed: Jan. 5, 2018

(86) PCT No.: PCT/KR2018/000229
§ 371 (c)(1),
(2) Date: Jul. 5, 2019

(87) PCT Pub. No.: WO2018/128445
PCT Pub. Date: Jul. 12, 2018

(65) Prior Publication Data

US 2019/0351437 A1 Nov. 21, 2019

(30) Foreign Application Priority Data

Jan. 6, 2017 (KR) ..... 10-2017-0002512

(51) Int. Cl.

| | |
|---|---|
| ***D06F 43/00*** | (2006.01) |
| ***B05B 9/04*** | (2006.01) |
| ***B05B 13/02*** | (2006.01) |
| ***B65D 25/20*** | (2006.01) |
| ***B65D 25/38*** | (2006.01) |
| ***D06F 5/00*** | (2006.01) |
| ***D06F 19/00*** | (2006.01) |

(52) U.S. Cl.
CPC ..... *B05B 9/0403* (2013.01); *B05B 13/0221* (2013.01); *B65D 25/20* (2013.01);
(Continued)

(58) Field of Classification Search
CPC ... D06F 5/00; D06F 7/04; D06F 19/00; D06F 43/002; A47L 25/00; A47L 25/08
See application file for complete search history.

(56) References Cited

U.S. PATENT DOCUMENTS 3,089,790 A * 5/1963 Balamuth ..... B08B 3/12 134/1
10,549,320 B2 * 2/2020 Shu ..... A47L 11/4083
(Continued)

FOREIGN PATENT DOCUMENTS

EP 2811062 12/2014
EP 3159447 4/2017
(Continued)

OTHER PUBLICATIONS

European Search Report dated Sep. 15, 2020 issued in Application No. 18736595.2.
(Continued)

*Primary Examiner* — David G Cormier
(74) *Attorney, Agent, or Firm* — KED & Associates LLP

(57) ABSTRACT

The present invention relates to a cleaning apparatus. The cleaning apparatus according to the present invention includes a first cleaner for spraying a first detergent through a first nozzle, a second cleaner for discharging a second detergent to an outside of a second nozzle, and a vibration unit for vibrating the second cleaner when the second cleaner discharges the second detergent.

18 Claims, 12 Drawing Sheets

(52) U.S. Cl.
CPC ..... *B65D 25/38* (2013.01); *D06F 5/00* (2013.01); *D06F 19/00* (2013.01); *D06F 43/002* (2013.01)

(56) References Cited

U.S. PATENT DOCUMENTS

| | | | | |
|---|---|---|---|---|
| 2004/0250844 | A1* | 12/2004 | Kumazaki | A47L 13/00 134/201 |
| 2005/0034488 | A1 | 2/2005 | Oh et al. | |
| 2014/0352366 | A1* | 12/2014 | Seo | D06F 39/088 68/17 R |
| 2015/0292139 | A1* | 10/2015 | Lee | B05B 14/30 68/214 |
| 2017/0096758 | A1* | 4/2017 | Fujiwara | D06F 43/002 |

FOREIGN PATENT DOCUMENTS

| | | |
|---|---|---|
| JP | 09-068130 | 3/1997 |
| JP | H 10-195758 | 7/1998 |
| JP | 2004-222890 | 8/2004 |
| KR | 10-2005-0051601 | 6/2005 |
| KR | 10-2009-0024905 | 3/2009 |
| KR | 10-2012-0068364 | 6/2012 |
| KR | 10-2012-0137066 | 12/2012 |
| WO | WO 2015/192689 | 12/2015 |

OTHER PUBLICATIONS

International Search Report dated May 8, 2018 issued in Application No. PCT/KR2018/000229.

* cited by examiner

CLEANING APPARATUS

CROSS-REFERENCE TO RELATED PATENT APPLICATIONS

This application is a U.S. National Stage Application under 35 U.S.C. § 371 of PCT Application No. PCT/KR2018/000229, filed Jan. 5, 2018, which claims priority to Korean Patent Application No. 10-2017-0002512, filed Jan. 6, 2017, whose entire disclosures are hereby incorporated by reference.

TECHNICAL FIELD

The present invention relates to a cleaning apparatus, and more particularly to a cleaning apparatus for spraying a detergent, which is used in a clothes treatment apparatus or the like.

BACKGROUND ART

In general, wool or silk clothes, which are not capable of being washed with water, are cleaned using a clothes treatment apparatus or the like. A process of cleaning clothes using a clothes treatment apparatus or the like is performed in such a way as to eliminate light contaminants adhering to the outer surface of a garment or to treat stains such as foodstuffs.

However, the two types of cleaning require the use of two different kinds of detergent. In order to use the two kinds of detergent, there is a need to use two types of detergent-spraying devices.

Cleaning for eliminating light contaminants requires one such detergent to be sprayed onto a garment, and cleaning for removing local stains requires another detergent to be applied to the stained portion of a garment.

Although Korean Patent Registration No. 10-1235747 discloses a stain-eliminating device, which is capable of using both a detergent and water to eliminate stains, there is a problem in that it is impossible to store and spray the two kinds of detergent used for the two types of cleaning.

DISCLOSURE

Technical Problem

It is an object of the present invention to provide a cleaning apparatus capable of storing and applying two kinds of detergent.

It is another object of the present invention to provide a cleaning apparatus that effectively eliminates local stains.

Technical Solution

In accordance with an aspect of the present invention, the above and other objects can be accomplished by the provision of a cleaning apparatus, which includes a first cleaner for spraying a first detergent through a first nozzle and a second cleaner for discharging a second detergent to the outside of a second nozzle, thereby storing two kinds of detergent in a single apparatus and spraying or discharging the respective detergents.

In accordance with an aspect of the present invention, the above and other objects can be accomplished by the provision of a cleaning apparatus, which includes a vibration unit for vibrating the second cleaner when the second cleaner discharges the second detergent, thereby discharging the detergent to a stained portion, which requires local washing, while applying physical pressure thereto.

The second cleaner includes a second cleaner container for storing the second detergent therein, a power terminal for allowing current to flow to the vibration unit, and the second nozzle for spraying the second detergent stored in the second cleaner container and for allowing current to flow to the power terminal, whereby the vibration unit is activated so as to apply physical impacts to a garment while the second nozzle sprays the second detergent.

Advantageous Effects

First, the cleaning apparatus according to the present invention offers an advantage of storing and applying two kinds of detergent, which are used in two types of cleaning, using a single apparatus, and of thus providing a user with convenience.

Second, the cleaning apparatus according to the present invention offers an advantage of applying physical impacts to a garment using the vibration unit and of thus improving the capability of eliminating local stains of the garment when a detergent for eliminating local stains is used.

DESCRIPTION OF DRAWINGS

FIG. 7(*b*) is a view illustrating a power terminal according to an embodiment of the present invention, which is in the state in which current flows thereto;

FIG. 10(*b*) is a view illustrating the state in which the cleaning apparatus is mounted in the mount according to an embodiment of the present invention;

illustrates the state in which the first detergent is sprayed through the first nozzle of the first cleaner.

BEST MODE

Hereinafter, the present invention will be described with reference to the drawings, which illustrate cleaning apparatuses according to embodiments of the present invention.

Figure 1:
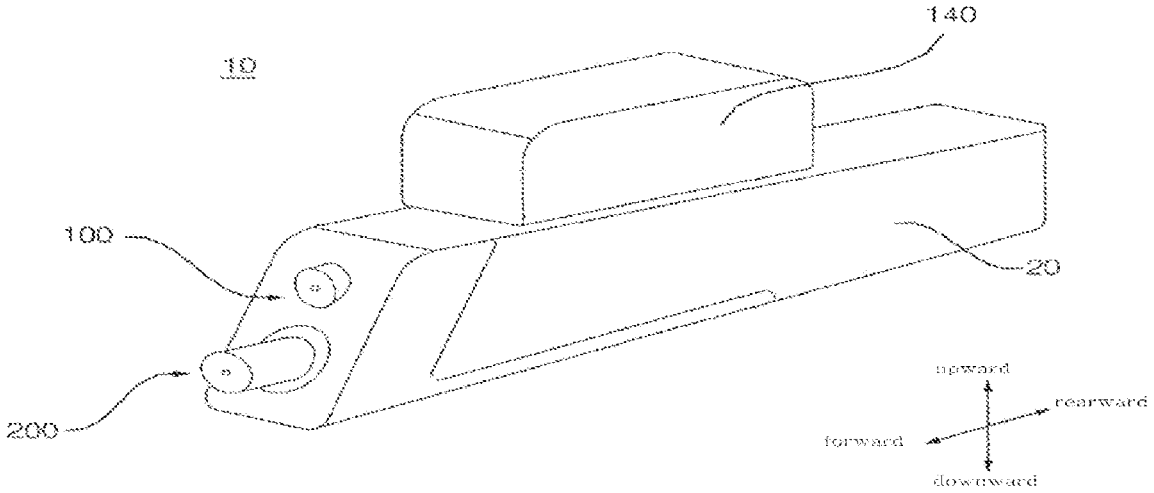
FIG. 1 is a perspective view of a cleaning apparatus according to an embodiment of the present invention.
Figure 2:
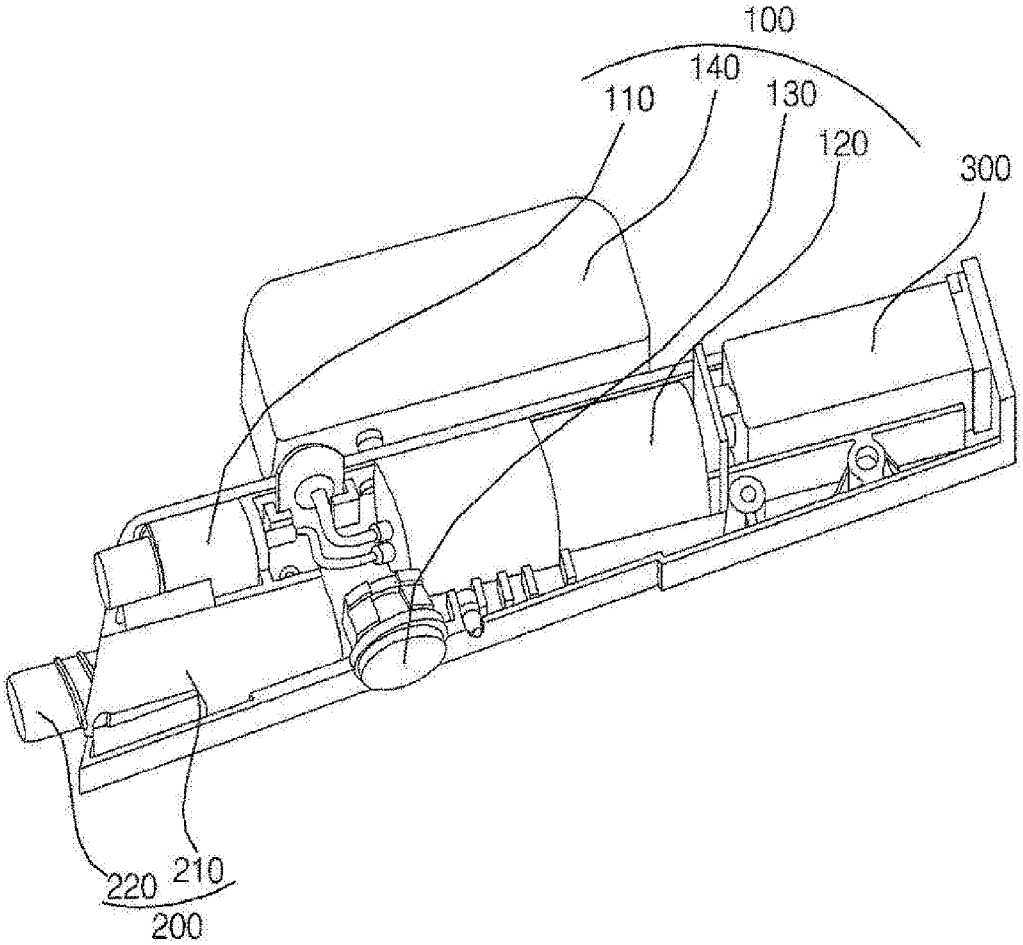
FIG. 2 is a view explaining a first cleaner and a second cleaner of the cleaning apparatus according to an embodiment of the present invention.
Figure 3:
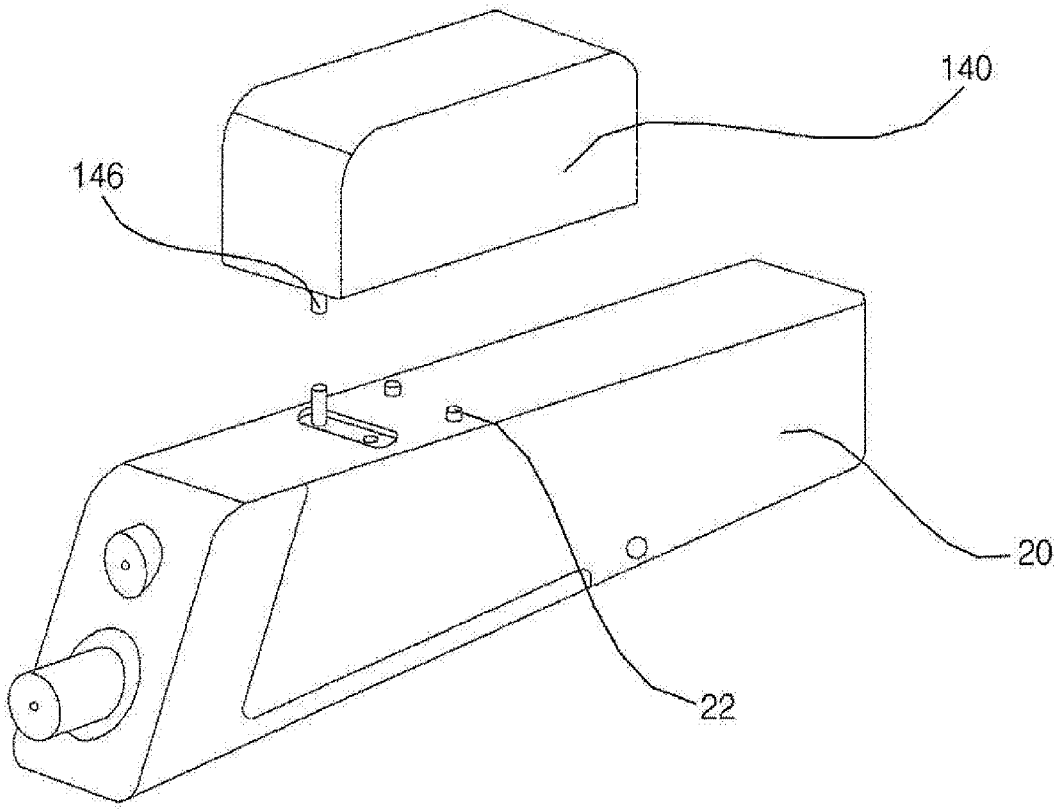
FIG. 3 is a view illustrating the cleaning apparatus and a storage kit mounted on the cleaning apparatus according to an embodiment of the present invention.
Figure 4:
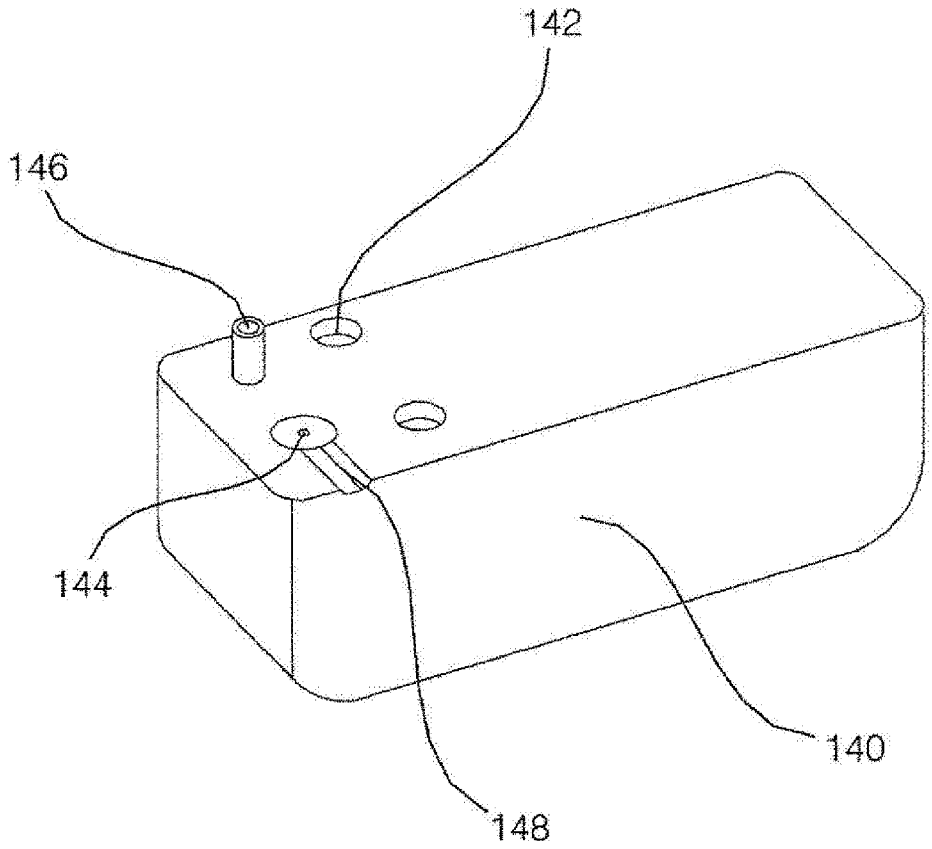
FIG. 4 is a bottom perspective view illustrating the storage kit according to an embodiment of the present invention.
Figure 5:
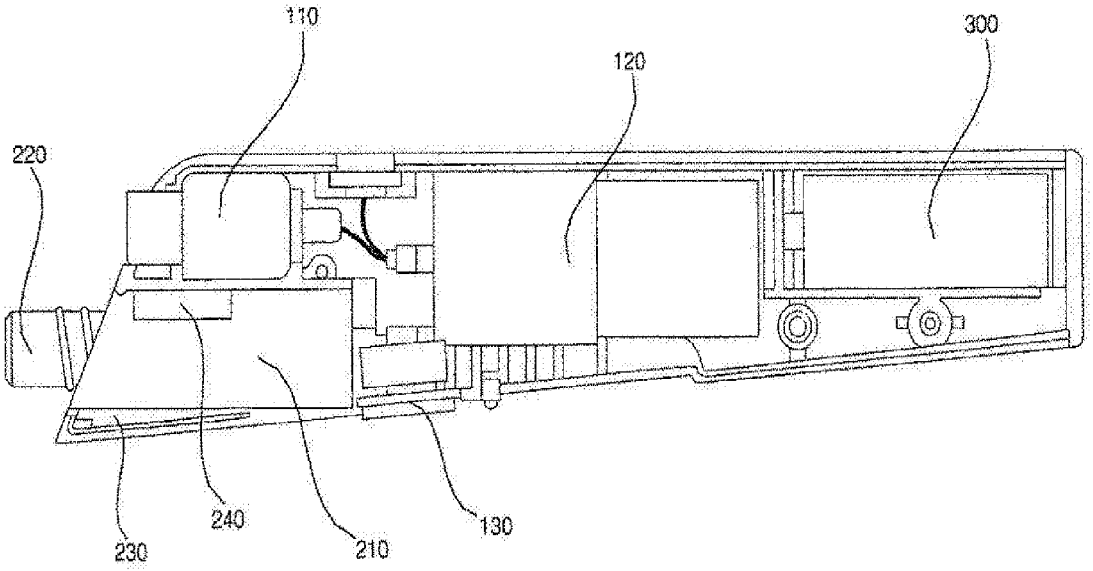
FIG. 5 is a view illustrating the interior of the cleaning apparatus according to an embodiment of the present invention.
Figure 6:
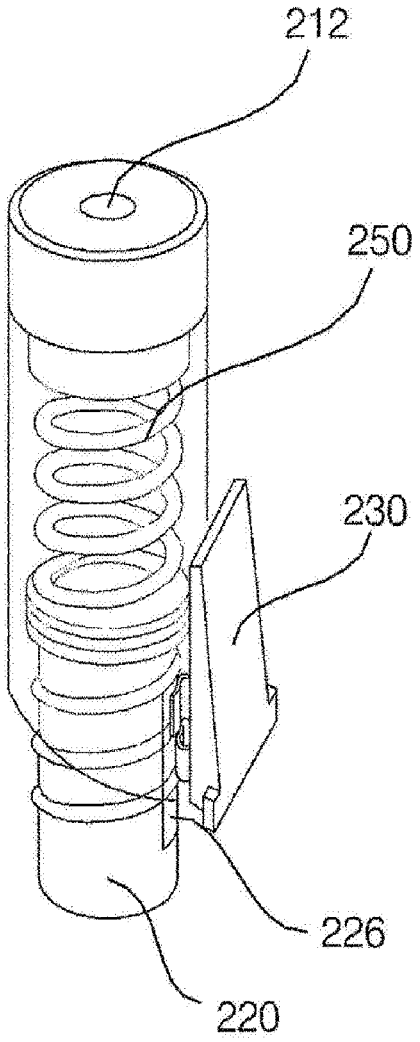
FIG. 6 is a view explaining the second cleaner of the cleaning apparatus according to an embodiment of the present invention.
Figure 7:
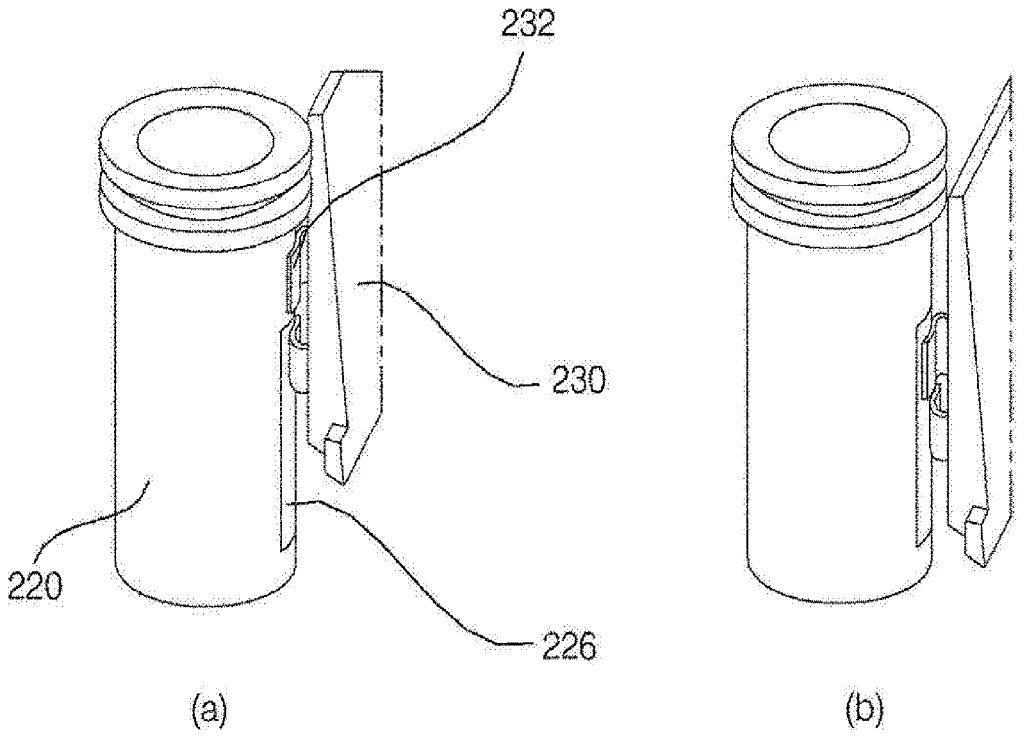
FIG. 7(*a*) is a view illustrating a power terminal according to an embodiment of the present invention, which is in the state in which current does not flow thereto.
Figure 8:
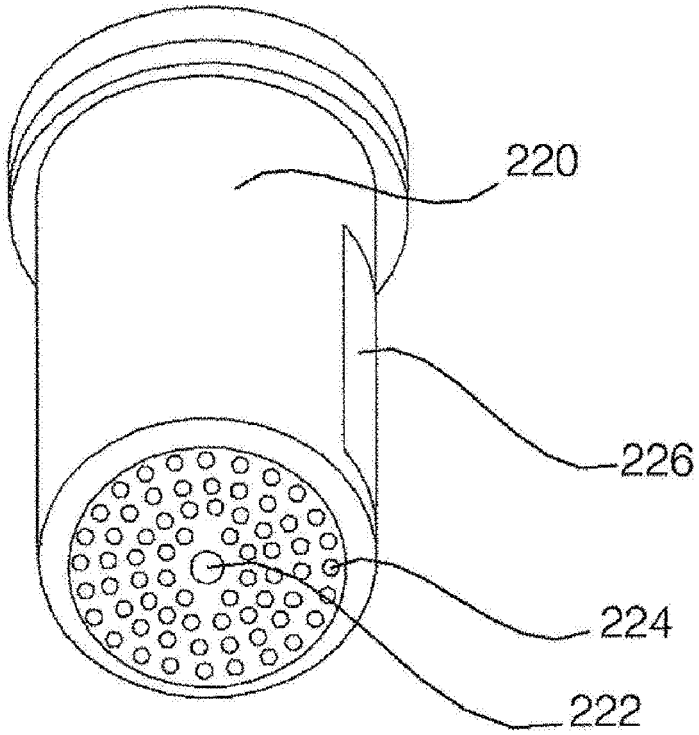
FIG. 8 is a view illustrating a second nozzle of the second cleaner according to an embodiment of the present invention.

FIG. 1 is a perspective view of a cleaning apparatus according to an embodiment of the present invention. FIG. 2 is a view explaining a first cleaner and a second cleaner of the cleaning apparatus according to an embodiment of the present invention. FIG. 3 is a view illustrating the cleaning apparatus and a storage kit mounted on the cleaning apparatus according to an embodiment of the present invention. FIG. 4 is a bottom perspective view illustrating the storage kit according to an embodiment of the present invention. FIG. 5 is a view illustrating the interior of the cleaning apparatus according to an embodiment of the present invention. FIG. 6 is a view explaining the second cleaner of the cleaning apparatus according to an embodiment of the present invention. FIG. 7 is a view illustrating a power terminal according to an embodiment of the present invention, in the state in which current does not flow thereto and in the state in which current flows thereto. FIG. 8 is a view illustrating a second nozzle of the second cleaner according to an embodiment of the present invention.

Hereinafter, the cleaning apparatus according to the embodiment will be described with reference to FIGS. 1 to 8.

The cleaning apparatus according to the embodiment includes a first cleaner 100 for spraying a first detergent through a first nozzle 110, a second cleaner 200 for discharging a second detergent to the outside from a second nozzle 220, and a vibration unit 240 for vibrating the second cleaner when the second cleaner discharges the second detergent.

The cleaning apparatus 10 according to the embodiment includes the second cleaner 200 for eliminating local contaminants and the first cleaner 100 for spraying the first detergent for the purpose of performing light cleaning on and caring for a luxury garment.

In the description of the cleaning apparatus 10 according to the embodiment, referring to FIGS. 1 and 2, the direction in which the first nozzle 110 and the second nozzle 220 are disposed in a case 20 is referred to as a forward direction with respect to a pump 120, and the direction in which a battery 300 is disposed in the case 20 is referred to as a rearward direction with respect to the pump 120. Furthermore, the direction in which a power switch 130 is disposed is referred to as a downward direction with respect to the pump 120, and the direction in which the storage kit 140 is disposed is referred to as an upward direction with respect to the pump 120. The definition of terms is intended to explain the cleaning apparatus 10 according to the embodiment, and is not intended to limit the scope of the present invention.

The cleaning apparatus 10 according to the embodiment further includes the case 20 surrounding the first cleaner 100, the second cleaner 200 and the vibration unit 240. The case 20 is provided in the front face thereof with holes in which the first nozzle 110 and the second nozzle 220 are disposed.

Hereinafter, the first cleaner according to the embodiment will be described with reference to FIGS. 1 to 4. The first cleaner 100 according to the embodiment includes the first nozzle 110 for spraying the first detergent to the outside, the pump 120 for supplying the first detergent to the first nozzle 110, and the power switch 130 for activating the pump 120.

The first cleaner 100 according to the embodiment further includes the storage kit 140 for storing the first detergent.

As the first detergent according to the embodiment, a detergent that includes water, a fluorine solvent, a water-soluble solvent, a cleaning booster and a shrinkage-preventing agent may be used as active ingredients. The fluorine-based detergent is a product containing a fluorine solvent, which has an excellent effect both on oil-based contaminants and aqueous contaminants and excellent polymer stability and which is safe to a human body and the environment and is non-flammable. Since the fluorine-based detergent is easily dried in general washing conditions, the detergent is suitable for use as a laundry detergent. The fluorine-based detergent is merely an example, and it is also possible to use a detergent containing another ingredient that is conventionally used in clothes-treatment apparatuses.

The first nozzle 110 is disposed in the front of the case 20. The first nozzle 110 sprays the first detergent supplied from the pump 120. The first nozzle 110 is connected to the pump 120. The first detergent is supplied from the pump under pressure of a predetermined level or higher, and is sprayed from the first nozzle 110.

The pump 120 supplies the first detergent stored in the storage kit 140 to the first nozzle 110. The pump 120 is electrically connected to the power switch 130. The pump 120 is activated by the power supplied from the battery 300. When the power switch 130 is pushed by a user, the pump 120 is activated.

The storage kit 140 is the space in which the first detergent is stored. The storage kit 140 is connected to the pump 120 so as to supply the first detergent to the pump 120. The storage kit 140 is mounted on the outer surface of the case 20. The storage kit 140 is detachably mounted on the case 20.

The storage kit 140 is provided in the surface thereof that contacts the case 20 with a detergent inlet 144, into which the first detergent is introduced, and a detergent outlet 146, from which the first detergent is discharged. The storage kit 140 includes an air hole 148, which extends to the lateral side surface of the case 20 from the portion thereof at which the detergent inlet 144 is formed. Even when the storage kit 140 is mounted on the case 20, a solution inlet 212 may communicate with the outside through the air hole 148 so as to allow air to flow therethrough. As the first detergent in the storage kit 140 is discharged from the detergent outlet 146, the inside of the storage kit 140 is filled with air through the air hole 148.

The storage kit 140 is provided in the surface thereof that contacts the case 20 with locking holes 142 for locking to the case 20. The case 20 is provided on a surface thereof with locking protrusions 22, which correspond to the locking holes 142. This is merely one example, and another example in which the locking protrusions 22 are formed on the storage kit 140 and the locking holes 142 are formed in the corresponding regions of the case 20 is also possible.

Hereinafter, the second cleaner according to the embodiment will be described with reference to FIGS. 1, 2 and 5 to 8. The second cleaner 200 according to the embodiment includes a second cleaner container 210 for storing the second detergent therein, the power terminal 230, which allows current to flow to the vibration unit 240, and the second nozzle 220 for spraying the second detergent stored in the cleaner container and for allowing current to flow through the power terminal 230.

The second cleaner container 210 stores the second detergent therein. The second cleaner container 210 is detachably mounted in the case 20. The second cleaner container 210 is provided in the rear surface thereof that is inserted into the case 20 with the second detergent inlet 144. The second nozzle 220 is disposed in the front surface of the second cleaner container 210 so as to be movable forwards and rearwards.

The second cleaner 200 includes an elastic member 250 in the second cleaner container 210 in order to apply elastic force to the second nozzle 220. The elastic member 250 applies elastic force to the second nozzle 220. The second nozzle 220 is disposed in the second cleaner container 210 so as to be movable forwards and rearwards. The second cleaner container 210 is provided in a side surface thereof with a hole through which the two terminals of the power terminal 230 extend.

The second nozzle 220 is movably disposed in the second cleaner container 210. The second nozzle 220 discharges the second detergent stored in the second cleaner container 210 to the outside. The second nozzle 220 is provided in the front surface thereof with a discharge hole 222 through which the second detergent is discharged.

The second nozzle 220 is provided on the outer periphery thereof with a conductive portion 226, which allows current to flow through the power terminal 230. The conductive portion 226 is a portion through which current flows. When the two terminals of the power terminal 230 are brought into contact with the conductive portion, current flows to the power terminal 230, thereby activating the vibration unit 240.

The second nozzle 220 may be disposed in the second cleaner container 210 between a first position, at which current does not flow to the power terminal 230, and a second position, at which current flows to the power terminal 230. The second nozzle 220 may be disposed in the second cleaner container 210 between the first position, at which only one terminal of the power terminal 230 is brought into contact with the conductive portion 226, and the second position, at which both terminals of the power terminal 230 are brought into contact with the conductive portion 226.

When a user pushes the front portion of the second nozzle 220, the second nozzle 220 is moved rearwards in the second cleaner container 210. The second nozzle 220 is disposed in front of the first nozzle 110. Even when the front portion of the second nozzle 220 is pushed, the first nozzle 110 is not affected. The first nozzle 110 is disposed behind the second nozzle 220 at the second position.

The first position also includes a position at which the second nozzle 220 is maximally pushed by the elastic member 250 and a position at which only one terminal of the power terminal 230 is brought into contact with the conductive portion 226, thereby interrupting the flow of current even when a predetermined pressure is applied to the second nozzle 220.

The second position includes a position at which the two terminals of the power terminal 230 are brought into contact with the conductive portion 226 when pressure of a predetermined level or higher is applied to the second nozzle 220.

The second nozzle 220 at the first position extends further forwards from the second cleaner container 210 than the second nozzle 220 at the second position. When external force is not applied, the second nozzle 220 is disposed at the first position due to the elastic force of the elastic member 250. When external force is applied to the front surface of the second nozzle 220, the second nozzle 220 is moved to the second position.

When the second nozzle 220 is disposed at the first position, current does not flow to the power terminal 230. When the second nozzle 220 is disposed at the first position, the vibration unit 240 is not activated. When the second nozzle 220 is disposed at the second position, current flows to the power terminal 230. When the second nozzle 220 is disposed at the second position, the vibration unit 240 is activated.

The front surface of the second nozzle 220 is provided with a plurality of protrusions 224 around the discharge hole 222. The plurality of protrusions 224 are radially formed around the discharge hole 222. The plurality of protrusions 224 define channels through which the second detergent, discharged from the front surface of the second nozzle 220, flows.

The vibration unit 240 vibrates the second cleaner 200. While the second detergent is discharged from the second nozzle 220 of the second cleaner 200, the vibration unit 240 vibrates the second cleaner 200. The vibration unit 240 applies physical impacts to a region of a garment to which the second detergent is discharged from the second cleaner 200. The vibration unit 240 according to the present invention may be embodied as a vibration motor, which vibrates laterally when power is supplied thereto.

The vibration unit 240 is disposed in the case 20. The vibration unit 240 is disposed at a region adjacent to the second cleaner container 210. The power from the battery 300 is supplied to the vibration unit 240. When current flows through the power terminal 230, the vibration unit 240 vibrates.

The power terminal 230 controls the power that is supplied to the vibration unit 240 from the battery 300. The power terminal 230 includes the two terminals, which are brought into contact with the conductive portion 226 of the second nozzle 220 so as to allow current to flow to the vibration unit 240.

When the second nozzle 220 is disposed at the first position in the second cleaner container 210, only one terminal of the power terminal is brought into contact with the conductive portion 226, thereby interrupting the supply of power to the vibration unit 240. When the second nozzle 220 is disposed at the second position in the second cleaner container 210, both terminals of the power terminal 230 are brought into contact with the conductive portion, thereby allowing current to be supplied to the vibration unit 240.

Hereinafter, the battery according to the embodiment will be described with reference to FIGS. 2 and 5.

The cleaning apparatus 10 according to the embodiment includes the battery 300 for activating the vibration unit 240 and the pump 120. The battery 300 is electrically connected to the vibration unit 240 and the pump 120. The battery 300 supplies power to the vibration unit 240 and to the pump 120.

The battery 300 according to the embodiment receives power from the outside in an electrical charging manner.

The battery 300 stores power, which is received through an electrical charge receiver disposed in the battery.

Figure 9:
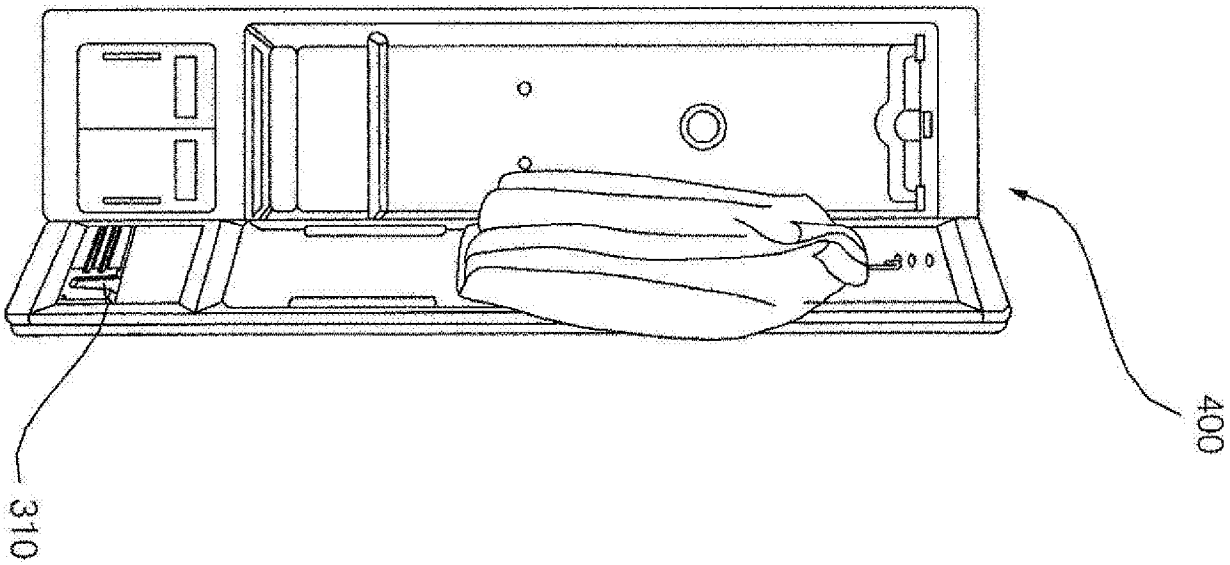
FIG. 9 is a view illustrating a clothes treatment apparatus in which a mount for the cleaning apparatus according to an embodiment of the present invention is disposed.
Figure 10:
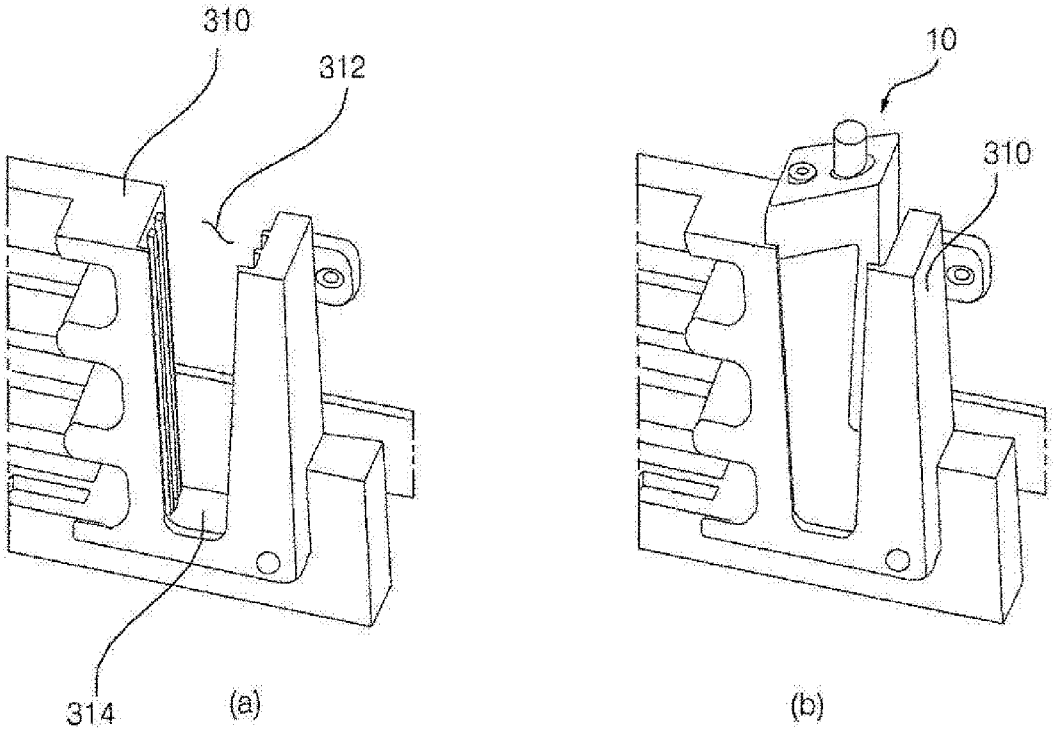
FIG. 10(*a*) is a view illustrating the mount according to an embodiment of the present invention.

FIG. 9 is a view illustrating a clothes treatment apparatus 400 in which a mount for the cleaning apparatus according to an embodiment of the present invention is disposed. FIG. 10 is a view illustrating the mount according to an embodiment of the present invention.

Hereinafter, the mount according to the embodiment will be described with reference to FIGS. 9 and 10.

The cleaning apparatus 10 according to the embodiment includes the mount 310 in which the cleaning apparatus 10 is mounted and is electrically charged. The mount 310 includes a mount groove 312, which is configured to have a shape corresponding to the contour of the case 20 so as to accommodate the case 20 therein. The mount includes a charge pad 314, which is disposed on the bottom of the mount groove 312 so as to electrically charge the battery 300 of the cleaning apparatus 10.

The charge pad 314 according to the embodiment supplies power to the electrical charge receiver in a wireless manner. The charge pad 314 supplies power in such a way as to generate induction voltage and to receive the induction voltage at the electrical charge receiver. However, this is only one example, and power supply in a wired manner by virtue of electrical docking is also possible. When the cleaning apparatus 10 is mounted in the mount 310, the charge pad 314 starts to charge the battery 300.

Figure 11:
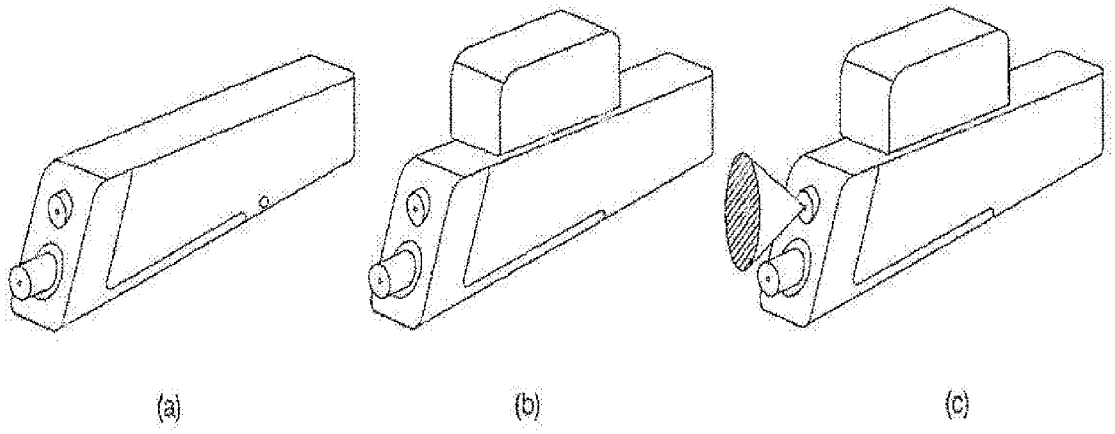
FIG. 11 is a view illustrating the sequence in which the first cleaner of the cleaning apparatus according to an embodiment of the present invention is used, in which (a) illustrates the state in which the storage kit is not mounted on the cleaning apparatus, (b) illustrates the state in which the storage kit is mounted on the cleaning apparatus, and (c)
Figure 12:
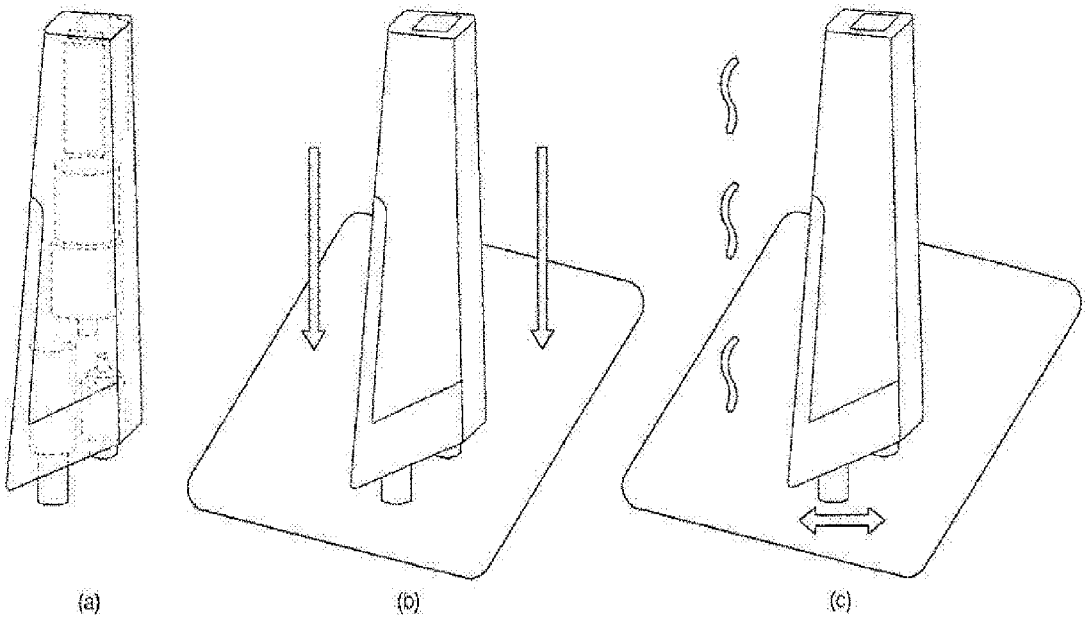
FIG. 12 is a view illustrating the sequence in which the second cleaner of the cleaning apparatus according to an embodiment of the present invention is used, in which (a) illustrates the state in which the second cleaner is mounted on the cleaning apparatus, (b) illustrates the state in which the front surface of the second cleaner is pushed, and (c) illustrates the state in which the vibration unit is operated due to movement of the second nozzle.

FIG. 11 is a view illustrating the sequence in which the first cleaner of the cleaning apparatus according to an embodiment of the present invention is used. FIG. 12 is a view illustrating the sequence in which the second cleaner of the cleaning apparatus according to an embodiment of the present invention is used.

Hereinafter, the procedure in which the cleaning apparatus is used will be described with reference to FIGS. 11 and 12.

The storage kit 140, which stores the first detergent therein, is mounted on the outer surface of the case 20. When the storage kit 140 is mounted on the outer surface of the case 20, the storage kit is ready to spray the first detergent from the first nozzle 110 using the pump 120. When a user pushes the power switch 130, the pump 120 is activated, whereby the first detergent stored in the storage kit 140 is sprayed from the first nozzle 110.

The second cleaner 200 stores the second detergent therein, and the second cleaner container 210 is mounted in the case 20. Since the second nozzle 220 is maintained at the first position even when the second cleaner container 210 is mounted in the case 20, the second detergent is not discharged to the outside, and the vibration unit 240 is not operated.

When a user brings the front surface of the second cleaner 200 into contact with a stained portion of a garment and then pushes the second cleaner 200, the second detergent in the second cleaner container 210 is discharged to the outside. At this time, the second detergent is discharged to a predetermined region of the garment by virtue of the protrusions 224 formed on the front surface of the second nozzle 220.

Furthermore, since the second nozzle 220 is moved to the second position in the second cleaner container 210 when the front surface of the second cleaner 200 is pushed, both terminals of the power terminal 230 are brought into contact with the conductive portion 226 of the second nozzle 220, thereby allowing current to flow to the power terminal 230. When the current flows to the power terminal 230, the power from the battery 300 is supplied to the vibration unit 240, and thus the vibration unit 240 vibrates the second cleaner 200, thereby applying physical impacts to the garment to which the second detergent is discharged.

The invention claimed is:

1. A cleaning apparatus comprising:

a first cleaner for spraying a first detergent through a first nozzle;

a second cleaner for discharging a second detergent to an outside of a second nozzle; and a vibrator for vibrating the second cleaner when the second cleaner discharges the second detergent, wherein the second cleaner includes:

a second cleaner container for storing the second detergent therein; and a power terminal for allowing current to flow to the vibrator, wherein the second nozzle is configured to spray the second detergent stored in the second cleaner container when current flows to the power terminal, wherein a front surface of the second nozzle includes a discharge hole, through which the second detergent is discharged, and a plurality of protrusions around the discharge hole, and wherein the second nozzle is configured to move in the second cleaner container between a first position, at which a conductive surface of the second nozzle does not contact the power terminal such that current does not flow to the power terminal, and a second position, at which the conductive surface of the second nozzle contacts the power terminal such that current flows to the power terminal.

2. The cleaning apparatus according to claim 1, further comprising:

a case surrounding the first cleaner, the second cleaner and the vibrator; and a first container, which is detachably mounted on an outer surface of the case so as to supply the first detergent to the first nozzle.

3. The cleaning apparatus according to claim 1, wherein the second nozzle is disposed in front of the first nozzle.

4. The cleaning apparatus according to claim 2, wherein the first cleaner includes a pump for supplying the first detergent stored in the first container to the first nozzle, and wherein the cleaning apparatus further comprises a battery for supplying power to the pump and the vibrator.

5. The cleaning apparatus according to claim 2, wherein the first container includes a surface that contacts the case, the surface of the first container includes a detergent inlet, into which the first detergent is introduced, and a detergent outlet, from which the first detergent is discharged, and the first container includes an air hole, which extends to a lateral side surface of the case from a portion thereof at which the detergent inlet is formed.

6. The cleaning apparatus according to claim 1, wherein the second cleaner further includes a spring, which is disposed in the second cleaner container so as to apply elastic force to the second nozzle, the second nozzle being maintained at the first position by the spring when no other force is applied to the second cleaner.

7. The cleaning apparatus according to claim 1, wherein the second nozzle is positioned further forward in the first position than in the second position.

8. The cleaning apparatus according to claim 1, wherein the power terminal includes a pair of terminals that contact the conductive surface of the second nozzle such that current flows between the pair of contacts when the second nozzle is in the second position, and wherein at least one of the pair of terminals does not contact the conductive surface of the second nozzle such that current does not flow between the pair of contacts when the second nozzle is in the first position.

9. The cleaning apparatus according to claim 1, wherein the conductive surface is provided on a circumferential surface of the second nozzle, and the discharge hole and the plurality of protrusions are provided on an axial end surface of the second nozzle.

10. The cleaning apparatus according to claim 1, wherein the vibrator includes a vibration motor.

11. A cleaning apparatus comprising:

a battery to store electrical power; and a cleaner to discharge a liquid;

wherein the cleaner includes:

a container to store the liquid therein;

a nozzle having a front surface that includes a discharge hole through which the liquid received from the container is discharged, and a plurality of protrusions provided around the discharge hole, a vibrator to vibrate the cleaner, and power terminal to selectively supply current from the battery to the vibrator, wherein current flows through the power terminal to the vibrator when the liquid is discharged through the nozzle, and wherein the nozzle is configured to move between a first position, at which a conductive surface of the nozzle does not contact the power terminal such that current does not flow to the power terminal, and a second position, at which the conductive surface of the nozzle contacts the power terminal such that current flows to the power terminal.

12. The cleaning apparatus according to claim 11, further comprising:

a case to receive at least a portion of the cleaner.

13. The cleaning apparatus according to claim 11, wherein the cleaner further includes a spring that applies elastic force to the nozzle, the nozzle being maintained at the first position by the elastic force of the spring when another force is not applied to the cleaner.

14. The cleaning apparatus according to claim 11, wherein the nozzle is positioned further forward in the first position than in the second position, and the nozzle moves toward the second position when another force is applied.

15. The cleaning apparatus according to claim 11, wherein power terminal includes a pair of terminals that contact the conductive surface of the nozzle when the nozzle is in the second position such that current flows between the pair of terminals via the conductive surface, and wherein at least one of the pair of terminals does not contact the conductive surface of the nozzle when the nozzle is in the first position.

16. The cleaning apparatus according to claim 1, to claim 11, wherein the conductive surface is provided on a circumferential surface of the nozzle, and the discharge hole and the plurality of protrusions are provided on an axial end surface of the nozzle.

17. The cleaning apparatus according to claim 11, wherein the vibrator includes a vibration motor.

18. The cleaning apparatus according to claim 11, wherein the cleaning apparatus is configured to be received in a mount of a clothes treatment apparatus, and the battery is configured to be charged when the cleaning apparatus is received in the mount of the mount of the clothes treatment apparatus.

* * * * *